United States Patent [19]

Bury

[11] 4,332,390

[45] Jun. 1, 1982

[54] TARGET WITH MAGNETICALLY-HELD, DISLODGEABLE INDICATOR

[76] Inventor: Joe Bury, Box 524, Buffalo, Wyo. 82834

[21] Appl. No.: 187,651

[22] Filed: Sep. 16, 1980

[51] Int. Cl.[3] ..... F41J 5/00

[52] U.S. Cl. ..... 273/389; 273/384

[58] Field of Search ..... 273/333, 334, 384, 385, 273/386, 387, 388, 389

[56] References Cited

U.S. PATENT DOCUMENTS

| | | | |
|---|---|---|---|
| 355,976 | 1/1887 | Crandall | 273/383 X |
| 1,120,265 | 12/1914 | Boyt | 273/387 |
| 1,170,828 | 2/1916 | Lamb | 273/386 X |
| 1,217,714 | 2/1917 | Cox | 273/375 |
| 2,074,009 | 3/1937 | Wunner | 273/387 |
| 2,926,916 | 3/1960 | Pearson, Jr. | 273/374 |
| 2,949,305 | 8/1960 | Davis | 273/384 |
| 3,165,317 | 1/1965 | Kirsch | 273/388 |
| 3,262,704 | 7/1966 | Abraham et al. | 273/384 X |

*Primary Examiner*—Anton O. Oechsle

*Attorney, Agent, or Firm*—Berman, Aisenberg & Platt

[57] ABSTRACT

An amusement device is provided having a target which is a comic representation of a person, such as a radio announcer, for example. The target is portrayed on a generally flat, vertical surface, having a large open mouth, defining a bull's-eye and a portion, such as a hairpiece or wig, which is dislodged when a missile projected by the player strikes the bull's-eye. The falling-off of the hairpiece shows the announcer to be bald and this visibly and humorously indicates the accurate throw or shot of the player. The hairpiece is preferably detachably secured to the target by magnets, and dislodgement is effected by a lever pivoted centrally behind the target with one end disposed behind the open mouth and the other end having an adjustable pin adapted to turn into a second opening in the target figure and strike against the hairpiece overcoming the hold of the magnets. A resilient means such as a rubber band is utilized to return the lever to its initial position against the rear of the announcer's mouth.

9 Claims, 11 Drawing Figures

FIG. 1
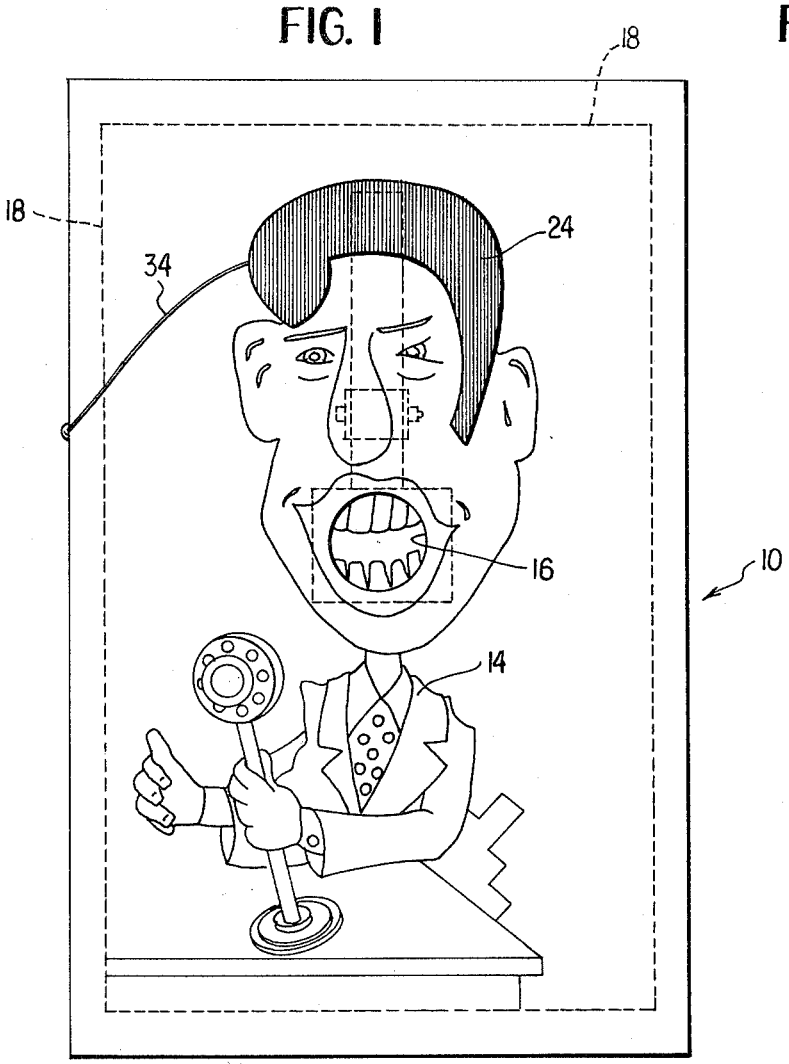
FIG. 2
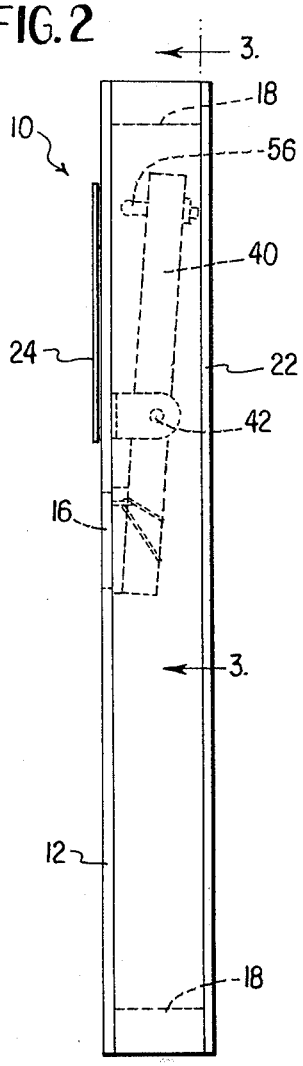
FIG. 3
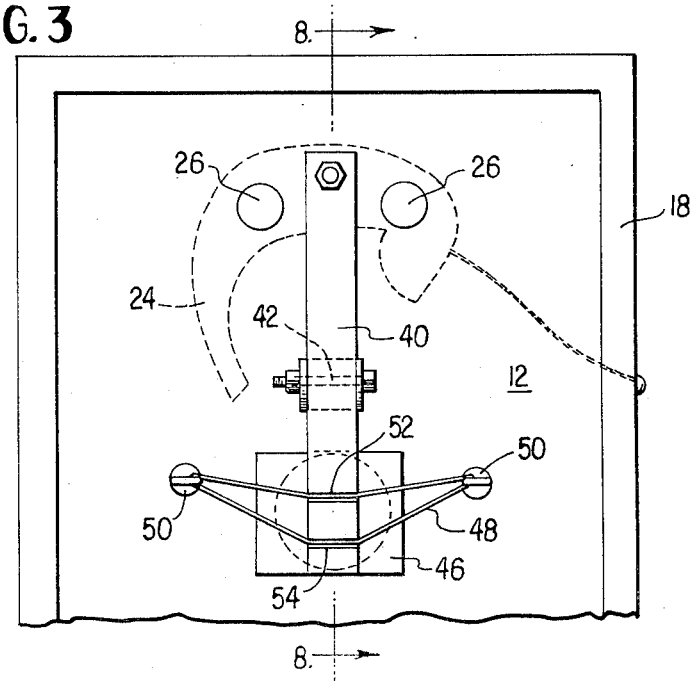
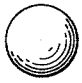
FIG. 4
BALL
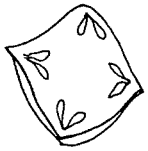
FIG. 5
SMALL BEANBAG
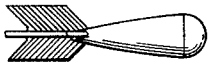
FIG. 6
DART
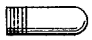
FIG. 7
PROJECTILE FIG. 9
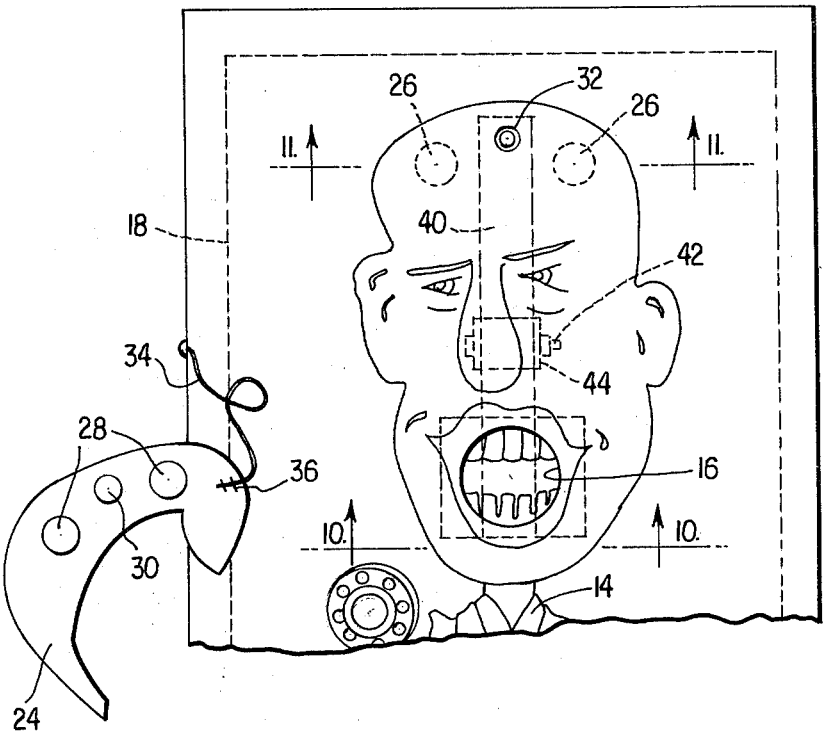
FIG. 8
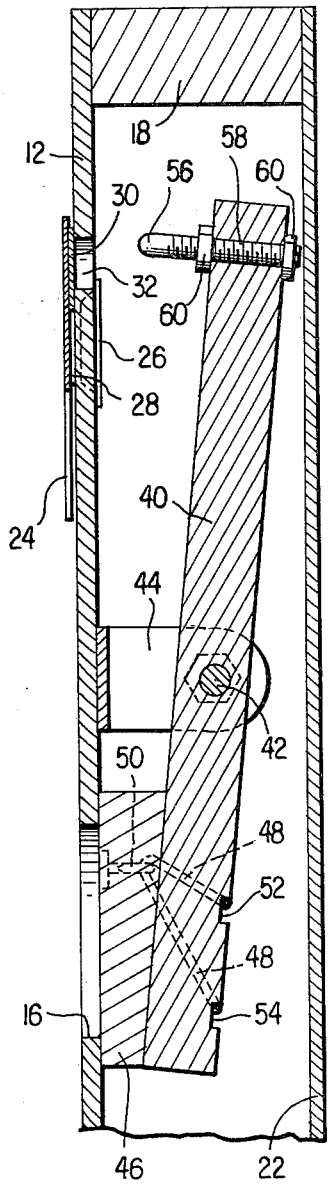
FIG. 10
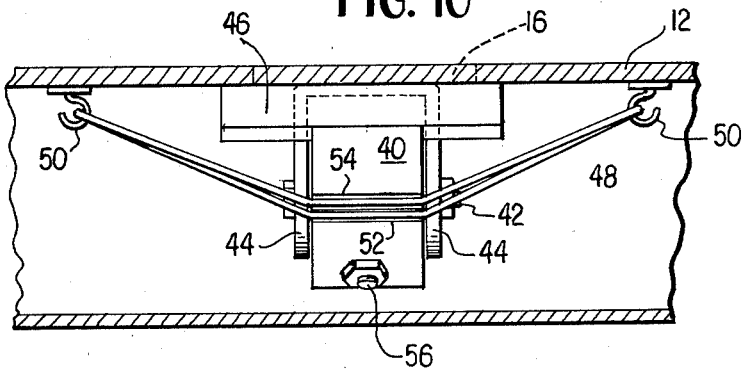
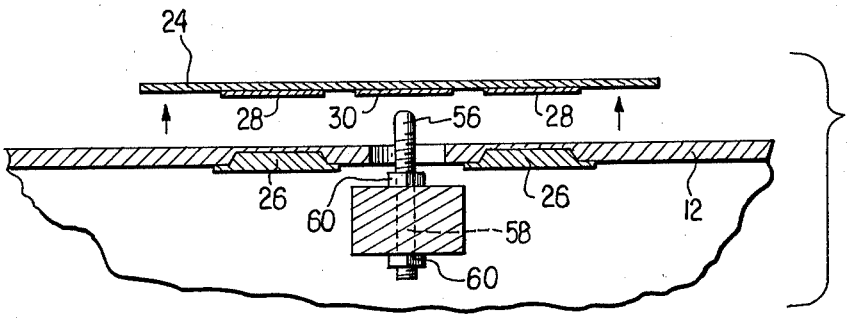
FIG. 11

TARGET WITH MAGNETICALLY-HELD, DISLODGEABLE INDICATOR

BACKGROUND OF THE INVENTION

1. Field of the Invention

The invention relates to amusement devices of the target game type and, more particularly, to a target which portrays the caricature of a person and has a movable portion spaced from the bull's-eye which is totally dislodged to humorously indicate the scoring of a direct hit.

2. The Prior Art

Amusement apparatus involving comic targets with a visual or audio indicator of a marksman's skill and having some similarity to the present invention are known in the prior art. Perhaps the most similar is revealed in U.S. Pat. No. 1,120,265, issued to O. J. Boyt. This patent discloses a comic, portly figure having three dimensions, like a doll, and whose target is a button in the front of its fat stomach. The button abuts a spring pressed plunger movable horizontally and whose other end abuts a bell crank arm. A second, vertically movable plunger is liftable by the second arm of the bell crank to turn the head and face of the target figure rearwardly about a hinge when the target button is struck by a ball or other missile. The present invention differs considerably in structure from the described prior art device. Firstly, all the parts are of simpler and less expensive construction, the target figure being printed or pasted on a two-dimensional flat sheet instead of being three dimensional and, secondly, the trigger apparatus comprises a pivoted straight lever parallel to the flat sheet instead of an assembly of a bell crank with two plungers, plunger guide and a target button. Thirdly, the hairpiece of the present invention is a flat, two dimensional part which is totally dislodged from the target figure when the bull's-eye is struck instead of being a three dimensional head which is merely turned on a hinge. The magnetic structure for holding the hairpiece on the target is also novel.

The U.S. Pat. No. 1,170,828 issued to S. R. Lamb is similar to the present invention in the use of a flat, planar target face whose open mouth forms the target area. In this patent, spring loaded teeth in the mouth disappear from sight when struck by a ball. However, the teeth are retained in pockets behind the target face when struck and are not totally dislodged from the target, nor is there any teaching of holding the teeth magnetically or of using a pivoted lever to dislodge them.

The U.S. Pat. No. 2,074,009 issued to J. Wunner discloses a target face with eyes, nose and chin buttons as specific targets. A very complex mechanism, including pivotal elements, is employed to elevate, turn and lower eye covering discs and to elevate a flag when the buttons are struck. This patent does not teach the use of a magnetically held, dislodgeable element which is completely removed from the target face by a simple pivoted bar when the bull's-eye is struck as in the present invention.

U.S. Pat. Nos. 2,926,916 and 1,217,714 granted to C. Pearson, Jr. and C. H. Cox respectively, also disclose target devices having moving parts together with audio indicators as well, to signal an accurate hit. These disclosed structures are considerably more complex than and have fewer similar ties to the present invention than the patents discussed above.

SUMMARY OF THE INVENTION

The present invention provides a comic picture of a news broadcaster, for example, mounted on a flat target sheet and having an open mouth which forms the target bull's-eye. A flat pictorial representation of a toupee is magnetically held on the target face. A simple bar lever, pivotally mounted behind the target sheet with one end disposed behind the open mouth and the other end having an adjustable pin adapted to turn into a second opening in the target face, is turned to strike and completely dislodge the wig, leaving the target bald-headed, when the bull's-eye is struck.

From the above, it should be noted that a primary object of the invention is to provide an amusement device having a very humorous visual indication of the skill of the player, in that direct hits result in total dislodgement of a toupee leaving the target figure bald.

Another important object of the invention is to provide an amusement device, having the above-described characteristics, which utilizes a very minimum number of parts of the simplest possible construction and readily accessible, thereby minimizing the cost of fabrication, rendering the apparatus durable in operation, and the parts easily reached for whatever little maintenance may be required.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of specific embodiments, when read in connection with the accompanying drawings, wherein like reference characters indicate like parts throughout the several figures and in which:

FIG. 1 is a front elevational view of the target assembly of the present invention;

FIG. 2 is a side elevational view of the target assembly;

FIG. 3 is a sectional view taken along line 3—3 of FIG. 2 and looking in the direction of the arrow;

FIGS. 4, 5, 6 and 7 are front elevations, respectively, of examples of different projectiles which may be thrown or shot at the target of FIGS. 1 through 3;

FIG. 8 is an enlarged sectional view taken along line 8—8 of FIG. 3 and looking in the direction of the arrows;

FIG. 9 is a fragmentary front elevation similar to FIG. 1, but showing the hairpiece dislodged as a result of a direct hit in the mouth of the target face;

FIG. 10 is an enlarged sectional view taken along line 10—10 of FIG. 9 and looking in the direction of the arrows; and FIG. 11 is an enlarged sectional view taken along line 11—11 of FIG. 10 looking in the direction of the arrows and showing the hairpiece at the moment just after dislodgement from the target face.

DESCRIPTION OF THE PREFERRED EMBODIMENTS

Referring now more particularly to the drawings, a preferred embodiment of the invention is illustrated in FIGS. 1 and 2, as including a target assembly 10 having a flat, vertical panel 12 on the front surface of which is drawn, painted, pasted or otherwise applied the comic caricature 14 of a broadcast announcer holding a microphone. The open mouth 16 of the target figure constitutes the target "bull's-eye", or specific target area intended to be struck by a missile, and this opening passes completely through the backing panel 12. The panel 12 is preferably formed of an inexpensive material of requisite durability and strength such as fiberboard, wood, or the like, and may be of metal, provided the metal is non-magnetic in the particular embodiment illustrated herein. The rear surface of the panel 12 is secured to a reenforcing, four-sided frame 18 of wood or the like, whose lower side may be used to seat the target 10 on a table, or other support. The rear of the target 10 may be closed by a panel 22 of cardboard, wood or the like, removably secured to frame 18 as by screws, not shown. The rear panel 22, when used, protects the trigger mechanism inside the target 10 and may also be used in the manner of a picture frame backing to hang the target on a wall.

Referring to FIG. 9, it will be seen that the head of the announcer 14 is portrayed as being bald, but in FIG. 1, the top of his skull and forehead is covered by a simulated hairpiece, toupee, or wig 24, of flat, crescent shape. The toupee is separate from and releasably secured to the target FIG. 12, preferably by magnetic means, although other types of fastenings may be used. In the preferred embodiment illustrated, a pair of disc magnets 26 are embedded in openings in the rear face of panel 12 at the level of the forehead of target announcer 14, and held therein by paper covers 27 pasted to panel 12. A pair of steel discs 28 are fastened to the rear surface of toupee 24. Discs 28 are spaced apart so as to directly overlie discs 26 and may have the opposite polarity, or may be formed of any magnetic metal which will be attracted by magnets 26. As illustrated particularly in FIGS. 8, 9 and 11, the embedded discs 26 extend in their openings very near to the front surface of panel 12 so that little magnetic strength is required to pass through the remaining thin covering of the panel and to attract and hold the discs 28 and the attached toupee 24. Between discs 28, the hairpiece 24 is provided with another disc 30, of metal or similar material, to strengthen the hairpiece and receive dislodgement blows of a trigger mechanism to be described. For this purpose, disc 30 covers a second opening 32 through panel 12 at the level of the forehead of the target announcer 14 when the hairpiece is secured in place by magnetic means 26,28. When the hairpiece 24 is dislodged from the target panel, it is prevented from rolling far by a cord 34 fastened to the hairpiece as by staples 36 at one end and to the target frame 18 at the other end.

The trigger mechanism for dislodging the hairpiece 24 comprises a lever or arm 40 centrally pivoted about pivot bolt 42 mounted through opposed openings in the legs of a U-shaped bracket 44 which is fastened to the rear surface of panel 12 at the nose level of the face of announcer 14. The lever 40 is preferably a straight, metal bar having a spacer block 46 fastened in any suitable manner to its lower end. Block 46 is a square plate thicker at the top than the bottom, and of sufficient size or otherwise suitably shaped to cover the rear edge of bull's-eye 16, so as to hold the lever slightly inclined from the vertical and to space the lever's upper end a small distance from opening 32 in the target face panel 12. The lower end of the lever 40 is biased toward the panel 12 so as to normally hold the spacer block 46 against the panel by a rubber band 48 whose ends are looped over spaced hooks 50 screwed into the rear of the panel, one on either side of opening 16. Desirably, a pair of grooves 52,54 are formed in the rear surface of the lever 40 to seat the courses of the looped rubber band. An adjustable pin mechanism is secured to the upper end of the lever 40 and arranged to enter opening 32 and strike disc 30 on the hairpiece when the lever is turned. This mechanism may comprise a threaded pin 56 slideably passing through an opening 58 in the top of the lever so as to extend forwardly and rearwardly of the lever. The amount of forward projection suitable for striking and dislodging the hairpiece is adjusted by the pair of nuts 60 threaded on the front and rear of pin 56.

FIGS. 4 through 7 illustrate a number of different missiles or projectiles which may be thrown or shot at the described target. As legended in these figures, a rubber or plastic ball, a bean bag, a blunt nosed dart, or a bullet-like element are each suitable for use and still others are possible to be used. In directing any of these missiles at the target opening, most of them, upon striking block 46, will bounce back to a position in front of the panel 12. However, should any fall within the frame 18 and back of the panel 12, it is possible to easily retrieve them through the opening 16, or by providing openings not shown in the bottom of either the frame 18 or rear panel 22.

In use of the target device 10 as described above, the panel 12, with hairpiece 24 magnetically secured thereto as pictured in FIG. 1, is placed on a support or hung on a wall and the players take turns throwing or firing one of the missiles depicted in FIGS. 4 through 7 at the bull's-eye 16. When a direct hit is scored against block 46 just behind the opening 16, the lever 40 is swung rearwardly at its lower end by force of the impact, turning the lever about its pivot 42 so that pin 56, at its upper end, enters opening 32 in panel 12 striking part 30 of the hairpiece 24 causing its dislodgement by overcoming the attractive force of the magnetic parts. The falling away of the hairpiece 24 leaves the target figure bald, as shown in FIG. 9, and thus serves as a humorous visual indication that a direct hit has been scored on the bull's-eye. The resilient band 48 immediately returns the lever 40 of the trigger mechanism to its initial position as shown in FIG. 8. One of the players then returns the toupee 24 to its covering position, shown in FIG. 1. The missile is retrieved and this or another missile may then be directed at the target. Such throwing may be continued until another direct hit is scored at which time the hairpiece is again dislodged by the trigger mechanism in the manner as previously described.

It should be apparent that the described game provides a comical visual indication of skill and accuracy in striking a target that is very appealing to participants, particularly children. At the same time, the game parts are of the simplest possible construction, very inexpensive to fabricate and easy to use and maintain operation. Furthermore, many changes in size, shapes and materials may be made without altering the general construction and mode of use or operation. One example of such a change would be to form the lever, block, pin assembly 40, 46, 56 of the trigger mechanism as a single, one-piece part.

Although certain specific embodiments of the invention have been shown and described, it is obvious that many modifications thereof are possible. The invention, therefore, is not intended to be restricted to the exact showing of the drawings and description thereof, but is considered to include reasonable and obvious equivalents.

What is claimed is:

1. An amusement device comprising a generally flat target figure having a dislodgeable portion and a first opening defining a bull's-eye, means releasably holding said dislodgeable portion on the target figure until a projectile enters said first opening, and means for dislodging said portion including an arm pivotally mounted behind said target figure, said arm having one end disposed immediately behind said first opening, means for biasing said one end toward the rear of the target figure, and means on the other end of the arm arranged to pass through a second opening in the target figure so as to strike and completely dislodge said portion from the target figure when the said one end of the arm is moved by the force of impact of a projectile, wherein said target figure is a comic representation of a human and said dislodgeable portion is a toupee which, when removed from the target figure, leaves the human bald, and wherein said means releasably holding said toupee comprises a pair of magnets secured to the rear of said target figure on opposite sides of said second opening, said toupee having magnetic metal plates secured to its rear surface and spaced to overlie and be held by said magnets.

2. An amusement device, as set forth in claim 1, wherein said magnets are inset in openings in the rear of said target figure.

3. An amusement device, as set forth in claim 1, wherein an elongated flexible cord is secured to said toupee at one end and has its other end connected to a rim portion of the target spaced considerably from the human representation, so that after the toupee has been dislodged, it may be easily retrieved and returned to the securement of the magnets ready for dislodgement by another projectile.

4. An amusement device comprising a generally flat target figure having a dislodgeable portion and a first opening defining a bull's-eye, means releasably holding said dislodgeable portion on the target figure until a projectile enters said first opening, and means for dislodging said portion including an arm pivotally mounted behind said target figure, said arm having one end disposed immediately behind said first opening, means for biasing said one end toward the rear of the target figure, and means on the other end of the arm arranged to pass through a second opening in the target figure so as to strike and completely dislodge said portion from the target figure when the said one end of the arm is moved by the force of impact of a projectile, wherein said target figure is a comic representation of a human and said dislodgeable portion is a toupee which, when removed from the target figure, leaves the human bald, and wherein said first opening is the mouth of the human, and said second opening is in human's forehead covered by said toupee, said arm forming part of the dislodging means being a substantially straight bar extending vertically and centrally pivoted to the rear surface of the target figure.

5. An amusement device, as set forth in claim 4, wherein said means on the arm for passing through the second opening is adjustable.

6. An amusement device, as set forth in claim 5, wherein said one end of the arm has attached thereto a spacer block which covers and rests against the inner edge of said first opening, said adjustable means in the other end of the arm including a threaded pin passing entirely through a loose bore in the arm and protruding toward the rear surface of the target figure, and a pair of nuts on the pin, one on each side of the arm, for changing the amount of protrusion of the pin.

7. An amusement device, as set forth in claim 4, wherein said biasing means is resilient.

8. An amusement device, as set forth in claim 7, wherein said resilient means biasing the arm toward the rear of the target figure comprises an endless rubber band having its ends looped over a pair of hooks fastened to the rear of the target figure, one on either side of said arm, the band being stretched by said hooks and pressing against the rear face of the arm.

9. An amusement device, as set forth in claim 8, wherein said rubber band is stretchedly engaged in grooves in the rear face of the arm.

* * * * *